US008662732B2

(12) United States Patent
Broitzman

(10) Patent No.: US 8,662,732 B2
(45) **Date of Patent: *Mar. 4, 2014**

(54) LIGHT EMITTING DIODE DEVICES CONTAINING REPLACEABLE SUBASSEMBLIES

(75) Inventor: Troy Richard Broitzman, Mound, MN (US)

(73) Assignee: LED Bulb L.L.C., Bonita Springs, FL (US)

( * ) Notice: Subject to any disclaimer, the term of this patent is extended or adjusted under 35 U.S.C. 154(b) by 386 days.

This patent is subject to a terminal disclaimer.

(21) Appl. No.: 12/772,885

(22) Filed: May 3, 2010

(65) Prior Publication Data

US 2010/0277068 A1 Nov. 4, 2010

Related U.S. Application Data

(60) Provisional application No. 61/215,106, filed on May 1, 2009.

(51) Int. Cl.
*F21V 29/00* (2006.01)
*F21V 21/00* (2006.01)

(52) U.S. Cl.
USPC ..... 362/640; 362/294; 362/362; 362/373; 313/46

(58) Field of Classification Search
USPC ..... 362/640, 294; 313/46
See application file for complete search history.

(56) References Cited

U.S. PATENT DOCUMENTS

| | | | | |
|---|---|---|---|---|
| 4,211,955 | A * | 7/1980 | Ray | 315/53 |
| 4,842,556 | A * | 6/1989 | Vogel | 439/638 |
| 6,715,900 | B2 * | 4/2004 | Zhang | 362/294 |
| 7,850,361 | B2 * | 12/2010 | Yu | 362/647 |
| 7,922,356 | B2 * | 4/2011 | Maxik et al. | 362/249.06 |
| 8,143,769 | B2 * | 3/2012 | Li | 313/46 |
| 8,419,225 | B2 * | 4/2013 | Zeng et al. | 362/294 |
| 2003/0235057 | A1 * | 12/2003 | Drews et al. | 362/515 |
| 2004/0046510 | A1 * | 3/2004 | Allen | 315/185 S |
| 2006/0061997 | A1 * | 3/2006 | Lin | 362/294 |
| 2007/0153526 | A1 * | 7/2007 | Lim | 362/294 |
| 2007/0167052 | A1 * | 7/2007 | Cherian | 439/232 |
| 2007/0195532 | A1 * | 8/2007 | Reisenauer et al. | 362/294 |
| 2008/0106893 | A1 * | 5/2008 | Johnson et al. | 362/228 |
| 2009/0079356 | A1 * | 3/2009 | Yang | 315/276 |
| 2009/0273940 | A1 * | 11/2009 | Thurgood et al. | 362/373 |

* cited by examiner

*Primary Examiner* — Sikha Roy
(74) *Attorney, Agent, or Firm* — Law Offices of Mark L. Berrier

(57) ABSTRACT

The present invention is directed generally to lighting devices, and more particularly to white light LED-based lighting devices configured such that key subassemblies may be replaced, thereby enabling the modification, upgrade and/or repair of said device.

15 Claims, 2 Drawing Sheets

LIGHT EMITTING DIODE DEVICES CONTAINING REPLACEABLE SUBASSEMBLIES

CROSS-REFERENCE TO RELATED APPLICATIONS

The present application claim the benefit of and priority to U.S. Provisional Application Ser. No. 61/215,106 Filed 1 of May, 2009 the entire content of which being incorporated herein by reference.

FIELD OF THE INVENTION

The present invention is directed generally to lighting devices, and more particularly to white light LED-based lighting devices configured such that key subassemblies may be replaced, thereby enabling the modification and/or repair of said device.

BACKGROUND

Energy conservation, in all its varied forms, has become a national priority of the United States as well as the rest of the world, from both the practical point of view of limited natural resources and recently as a security issue to reduce our dependence on foreign oil. A large proportion (some estimates are as high as one third) of the electricity used in residential homes in the United States each year goes to lighting. The percentage is much higher for businesses, streetlights, amongst other varied items. Accordingly, there is an ongoing need to provide lighting, which is more energy efficient. It is well known that incandescent light bulbs are very energy inefficient light sources—about ninety percent of the electricity they consume is released as heat rather than light. This heat adds to the cooling load of a system during cooling season. In heating season the cost per BTU of heat that the lights give off is typically more expensive than the cost per BTU of the main heat source. The heat that is given off by the lighting also can cause "over shooting" of the desired temperature which wastes energy and makes the space feel uncomfortable. Fluorescent light bulbs are more efficient than incandescent light bulbs (by a factor of about four) but are still quite inefficient as compared to solid-state light emitters, such as light emitting diodes (LED's).

In addition, as compared to the normal lifetimes of solid-state light emitters, incandescent light bulbs have relatively short lifetimes, i.e., typically in the range of 750 to 2000 hours. Fluorescent bulbs have longer lifetimes (e.g., 8,000 to 20,000 hours), but provide less favorable color reproduction. In dramatic comparison, the lifetime of light emitting diodes, for example, can generally be measured in decades (approximately 100,000 hrs or more).

One established method of comparing the output of different light generating sources has been coined "color reproduction". Color reproduction is typically given numerical values using the so-called Color Rendering Index (CRI). CRI is a relative measurement of how the color rendition of an illumination system compares to that of a blackbody radiator, i.e., it is a relative measure of the shift in surface color of an object when lit by a particular lamp. The CRI equals 100 if a set of test colors being illuminated by an illumination system are the same as the results as being irradiated by a blackbody radiator. Daylight has the highest CRI (100) with incandescent bulbs being relatively close (about 95), and fluorescent lighting being less accurate (70 to 85). Certain types of specialized lighting have relatively low CRI's (e.g., mercury vapor or sodium, both as low as about 40 or even lower). Sodium lights are used, e.g., to light highways and surface streets. Driver response time, however, significantly decreases with lower CRI values (for any given brightness, legibility decreases with lower CR1).

A practical issue faced by conventional lighting systems is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on a typical usage of 6 hours per day for 20 years). In contrast light-producing device lifetimes are typically much shorter, thus creating the need for periodic change-outs. The potential number of residential homes that may be candidates for these periodic change-outs of the traditional incandescent lighting systems, including base fixtures and lamps themselves, may be extremely large and represent an attractive commercial enterprise. For example, in the United States alone new residential home construction has average approximately 1.5 million dwellings per year over the last 30 years running. Even neglecting older homes built before 1978, this represents at least 45 million residential dwellings that are candidates for potential upgrades to more energy efficient LED-based lighting systems.

Accordingly, for these and other reasons, efforts have been ongoing to develop ways by which solid-state light emitters can be used in place of incandescent lights, fluorescent lights and other light-generating devices in a wide variety of applications. In addition, where solid state light emitters are already being used, efforts are ongoing to provide solid state light emitter-containing devices which are improved energy efficiency, color rendering index (CRI), contrast, and useful lifetime.

Light emitting diodes are well-known semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when an electrical potential difference is applied across a p-n junction structure. There are a number of well-known ways to make light emitting diodes and many associated structures, and the present invention can employ any such manufacturing technique.

The commonly recognized and commercially available light emitting diodes that are sold, for example, in electronics stores typically represent a "packaged" device made up of a number of parts. These packaged devices typically include a semiconductor-based light emitting diode and a means to encapsulate the light emitting diode. As is well known, a light emitting diode produces light by exciting electrons across the band gap between a conduction band and a valence band of a semiconductor active (light-emitting) layer. The electron transition generates light at a wavelength that depends on the band-gap energy difference. Thus, the color of the light (usually expressed in terms of its wavelength) emitted by a light emitting diode depends on the semiconductor materials of the active layers of the light emitting diode.

Although the development of solid state light emitters, e.g., light emitting diodes, has in many ways revolutionized the lighting industry, some of the characteristics of solid state light emitters have presented challenges, some of which have not yet been fully met. For example, the emission spectrum of any particular light emitting diode is typically concentrated around a single wavelength (as dictated by the light emitting diode's composition and structure), which is desirable for some applications, but not desirable for others, e.g., for providing lighting, given that such an emission spectrum typically provides a very low CRI.

Because light that is perceived as white is necessarily a blend of light of two or more colors (or wavelengths), no single light emitting diode can produce white light. "White light" emitting devices have been produced which have a light emitting diode structure comprising individual red, green and blue light emitting diodes mounted on a common substrate. Other "white light" emitting devices have been produced which include a light emitting diode which generates blue light and a luminescent material (e.g., a phosphor) that emits both red and green in response to excitation by the blue LED output, whereby the blue, red and green when appropriately mixed, produce light that is perceived as white light. A wide variety of luminescent materials are well-known and available to persons of skill in the art. For example, a phosphor is a luminescent material that emits a responsive radiation (typically visible light) when excited by a source of exciting radiation. In many instances, the responsive radiation has a wavelength, which is different, typically longer, from the wavelength of the exciting radiation. Other examples of luminescent materials include day glow tapes and inks, which glow in the visible spectrum upon illumination with ultraviolet light. Luminescent materials can be categorized as being down-converting, i.e., a material which converts photons to a lower energy level (longer wavelength) or up-converting, i.e., a material which converts photons to a higher energy level (shorter wavelength). Inclusion of luminescent materials in LED devices has typically been accomplished by adding the luminescent materials to a clear plastic encapsulating material (e.g., epoxy-based or silicone-based material).

As noted above, "white LED lights" (i.e., lights which are perceived as being white or near-white) have been investigated as potential replacements for white light incandescent lamps. A representative example of a white LED lamp includes a package of a blue light emitting diode chip, made of gallium nitride (GaN), coated with a phosphor such as Yttrium Aluminum Garnet (YAG). In such an LED lamp, the blue light emitting diode chip produces a blue emission and the phosphor produces yellow fluorescence on adsorbing that emission. For instance, in some designs, white light emitting diodes are fabricated by forming a ceramic phosphor layer on the output surface of a blue light-emitting semiconductor light emitting diode. Part of the blue rays emitted from the light emitting diode pass through the phosphor, while part of the blue rays emitted from the light emitting diode chip are absorbed by the phosphor, which becomes excited and emits a yellow ray. The part of the blue light emitted by the light emitting diode, which is transmitted through the phosphor, is mixed with the yellow light emitted by the phosphor. The viewer perceives the mixture of blue and yellow light as white light.

In another type of LED lamp, a light emitting diode chip that emits an ultraviolet ray is combined with phosphor materials that produce red (R), green (G) and blue (B) light rays. In such an "RGB LED lamp", the ultraviolet rays that have been radiated from the light emitting diode excites the phosphor, causing the phosphor to emit red, green and blue light rays which, when mixed, are perceived by the human eye as white light. Consequently, white light can also be obtained as a mixture of these light rays.

Designs have been realized in which existing LED's and other electronics are assembled into an integrated housing fixture. In such designs, an LED or plurality of LED's are mounted on a circuit board encapsulated within the housing fixture, and a heat sink is typically mounted to the exterior surface of the housing fixture to dissipate heat generated from within the device, the heat being generated by inefficient AC-to DC conversion from with the device. Typically, designs of this type are configured to be non-repairable when the LED's or other internal components fail, in these cases the devices are simply discarded. Also, designs of this type make it impossible to "upgrade" the devices to more efficient LED's as they become available.

Given this, there is a need for a "white light" Led device capable of being configured such that key subassemblies may be replaced, thereby enabling the modification and/or repair of said device.

SUMMARY OF THE INVENTION

Generally, the present invention is directed to lighting devices, and more particularly to white light LED-based lighting devices configured such that key subassemblies may be replaced, thereby enabling the modification and/or repair of said device.

One embodiment of the present invention describes a lighting device for generating diffuse white light comprising a group of solid state light emitters, said group including light emitting diodes energized by a direct current (DC) voltage, electronics to activate the solid state light emitters, wherein the electronics converts 120 volt 60 cycles per second alternating current (AC) to a steady state direct current (DC) voltage, a first encapsulating housing enclosing the solid state light emitters and the activating electronics, a second housing employing a heat sinking surface as the encapsulating surface, and said first and second housing in secure mechanical contact to form a shape and form factor substantially equivalent to the American National Standards Institute (ANSI) R-20, R-30, R-38, R-40, BR-20, BR-30, BR-38, BR-40, PAR-16, PAR-20, PAR-30, PAR-38, PAR-40, MR-16, A-15, A-19, A-21, A-23, B-10-1/2, B-13, G-16-1/2, G-25, G-40, P-25, PS-35, T-10, C-7, F-10, F-15, F-20 lighting device structure.

Another embodiment of the present invention describes a lighting device for generating diffuse white light comprising a group of solid-state light emitters, said group including light emitting diodes energized by a direct current (DC) voltage, electronics to activate the solid state light emitters, wherein the electronics converts 120 volt 60 cycles per second alternating current to a steady state direct current (DC) voltage, a first encapsulating housing enclosing the solid state light emitters, a second encapsulating housing enclosing the activating electronics, a third housing employing a heat sinking surface as the encapsulating surface, and said first, second, and third housing in secure mechanical contact to form a shape and form factor substantially equivalent to the American National Standards Institute (ANSI) R-20, R-30, R-38, R-40, BR-20, BR-30, BR-38, BR-40, PAR-16, PAR-20, PAR-30, PAR-38, PAR-40, MR-16, A-15, A-19, A-21, A-23, B-10-1/2, B-13, G-16-1/2, G-25, G-40, P-25, PS-35, T-10, C-7, F-10, F-15, F-20 lighting device structure.

Another embodiment of the present invention describes a lighting device for generating diffuse white light comprising a group of solid-state light emitters, said group including light emitting diodes energized by an alternating current (AC) drive voltage, a housing configured to supply a 120 volt AC (60 Hertz) input signal to the base of the lighting device, electronics to activate the solid state light emitters, wherein the electronics may be configured as an AC-to-AC converter to apply the appropriate AC voltage(s) and drive currents to the AC driven LEDs, a first encapsulating housing enclosing the solid state light emitters and the activating electronics, a second housing employing a heat sinking surface as the encapsulating surface, and said first and second housing in secure mechanical contact to form a shape and form factor substantially equivalent to the American National Standards Institute (ANSI) R-20, R-30, R-38, R-40, BR-20, BR-30, BR-38, BR-40, PAR-16, PAR-20, PAR-30, PAR-38, PAR-40, MR-16, A-15, A-19, A-21, A-23, B-10-1/2, B-13, G-16-1/2, G-25, G-40, P-25, PS-35, T-10, C-7, F-10, F-15, F-20 lighting device structure.

Another embodiment of the present invention describes a lighting device for generating diffuse white light comprising, a group of solid state light emitters, said group including light emitting diodes energized by an alternating current (AC) drive voltage, a housing configured to supply a 120 volt AC (60 Hertz) input signal to the base of the lighting device, electronics to activate the solid state light emitters, wherein the electronics may be configured as an AC-to-AC converter to apply the appropriate AC voltage(s) and drive currents to the AC driven LEDs, a first encapsulating housing enclosing the solid state light emitters, a second encapsulating housing enclosing the activating electronics, a third housing employing a heat sinking surface as the encapsulating surface, and said first, second, and third housing in secure mechanical contact to form a shape and form factor substantially equivalent to the American National Standards Institute (ANSI) R-20, R-30, R-38, R-40, BR-20, BR-30, BR-38, BR-40, PAR-16, PAR-20, PAR-30, PAR-38, PAR-40, MR-16, A-15, A-19, A-21, A-23, B-10-1/2, B-13, G-16-1/2, G-25, G-40, P-25, PS-35, T-10, C-7, F-10, F-15, F-20 lighting device structure.

BRIEF DESCRIPTION OF THE DRAWINGS

The invention may be more completely understood in consideration of the following detailed description of various embodiments of the invention in connection with the accompanying drawings, in which.

Figure 1:
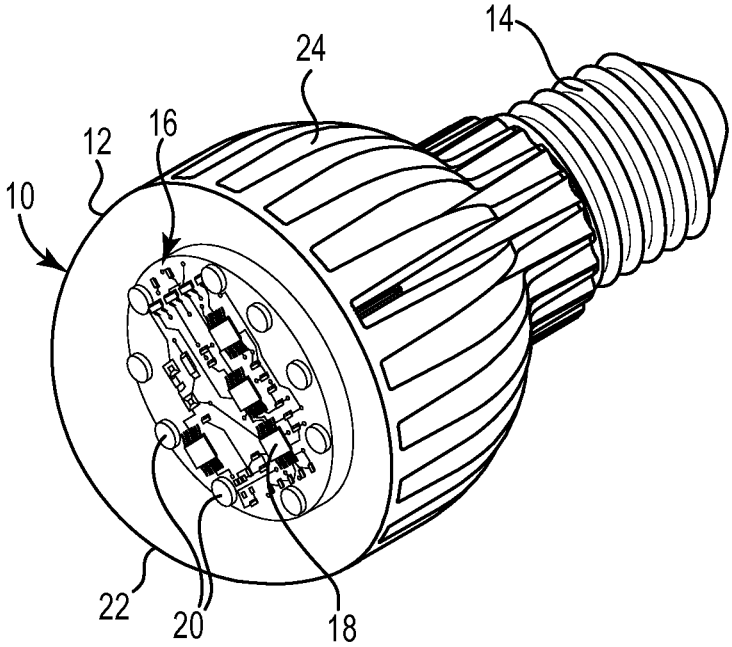
FIG. 1 shows a schematic representation of one embodiment of the present invention depicting a white light LED device configured for direct replacement of existing incandescent devices categorized by the American National Standards Institute (ANSI) as having part number R-20.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

In general, the present invention is directed to lighting devices, and more particularly to white light LED-based lighting devices configured such that key subassemblies may be replaced, thereby enabling the modification and/or repair of said device.

One embodiment of a white light LED device 10 in accordance with the present invention is depicted schematically in FIG. 1. Incandescent light bulb devices with the shape and form factor depicted in FIG. 1 have generally been categorized by the American National Standards Institute (ANSI) as having part numbers R-20, R-30, R-38 and/or R-40, the difference being their height and diameter, increasing with higher numerical designation. Alternative incandescent devices have been designed with a similar, but not identical, shape and form factor incorporating a slight bulge in their base section and have been designated by ANSI with a "BR" prefix to highlight this feature. For example, the BR-20 incandescent light bulb has a similar height and diameter as its' R-20 counterpart. Alternative incandescent devices have been designed with a similar, but not identical, shape and form factor incorporating a slight bulge in their base section and have been designated by ANSI with a "PAR" prefix to highlight this feature. For example, the PAR-38 incandescent light bulb has a similar height and diameter as its' R-38 counterpart. FIG. 1 of the present invention is intended to represent the entire family of incandescent light bulbs with the "R", "PAR" and "BR" designation including, but not limited to, those having part numbers R-20, R-30, R-38, R-40, PAR-20, PAR-30, PAR-38, PAR-40, BR-20, BR-30, BR-38, and BR-40.

As shown in FIG. 1, circuit board 16 may be securely mounted within encapsulating housing 12. Encapsulating housing 12 may consist of a similar shape and form factor currently in use for standard incandescent lighting devices, also generally categorized as having a part number R-20, R-30, R-38, or R-40. Encapsulating housing 12 may be comprised of a glass, ceramic, plastic or polymer-based material and may also include a reflective material on its inboard lateral surface and its' end-face 22 may be treated by any of a number of techniques (e.g., sand blasting) which give it a diffusing property to light emanating from the end-face of the white light LED device 10. Circuit board 16 may have individual electronic and optical components 18 mounted to its surface, which may include LED device structures 20 which are designed to be energized by an alternating (AC) or direct current (DC) voltage. In one embodiment of the present invention, circuit board 16 may include the necessary electronic components to convert the standard 120 volt AC (60 Hertz) signal to a direct current (DC) voltage appropriate for direct current driven LED's mounted on circuit board 16.

To generate white light, circuit board 16 may have individual red, green, and blue DC driven LEDs mounted in sufficiently close proximity such that their respective light outputs are spatially mixed and directed towards surface 22. Circuit board 16 may also include the appropriate electronic components 18 to alter the luminous flux output of the LED's (commonly measured in units of lumens) and also modify the so-called color temperature of the white light LED device 10. The color temperature, commonly stated in units of degrees Kelvin, is a measure of the peak wavelength of light emitted from a radiating body. It is commonplace in the light bulb industry to refer to incandescent white light devices that have a color temperature in the range of 2800 to 3200 degrees Kelvin as being a "warm" color, whereas compact fluorescent lighting devices which typically have a color temperature in the range of 5800 to 6200 degrees Kelvin are referred to as being a "cool" color.

Circuit board 16 may alter the color temperature of white light LED device 10 by varying the ratio of the steady state direct current (DC) voltages to the individual red, green, and blue light emitting diodes. For example, to generate a more "warm" color in the range of 2800 to 3200 degrees Kelvin, the electronic components 18 on circuit board 16 may be chosen to deliver slightly more current to the red LED than to either the blue or green LED's. Similarly, to generate a more "cool" color similar to a compact fluorescent bulb, the electronic components 18 on circuit board 16 may be chosen to deliver slightly more current to the blue LED than to either the green of red LED. In one embodiment of the present invention, the electronic components 18 on circuit board 16 may be configured to receive a remote command via a wireless RF link or equivalent means, to alter the current to the individual red, green, and blue LED's. Given this, both the luminous flux output (measured in Lumens) of the white light LED device 10 and the color temperature of the white light LED device 10 may be modified via remote control by varying the amplitude and ratio of the currents to the individual red, green, and blue LED's.

Alternatively, circuit board 16 may have one or more DC driven ultraviolet or blue LEDs that emit ultraviolet (or blue) rays which when partially absorbed by phosphor materials produce red (R) and green (G) light rays. In such an "RGB LED lamp", the red, green and blue light rays which, when mixed, are perceived by the human eye as white light.

In an alternative embodiment of the present invention, mounting threads 14 may securely mate with a housing configured to supply a direct current (DC) voltage to white light LED device 10. In this configuration, circuit board 16 may be configured as a DC-to-DC converter to apply the appropriate DC voltage(s) and drive currents to the DC driven LEDs mounted thereon.

In another embodiment of the present invention, the LED devices mounted on circuit board 16 may be compatible with an alternating current (AC) drive voltage. In this configuration, circuit board 16 may be configured to accept a 120 volt AC (60 Hertz) input signal and convert that signal to an AC signal appropriate for the individual LEDs mounted thereon.

In another embodiment of the present invention, the LED devices mounted on circuit board 16 may be DC driven organic light emitting diodes.

Figure 3:
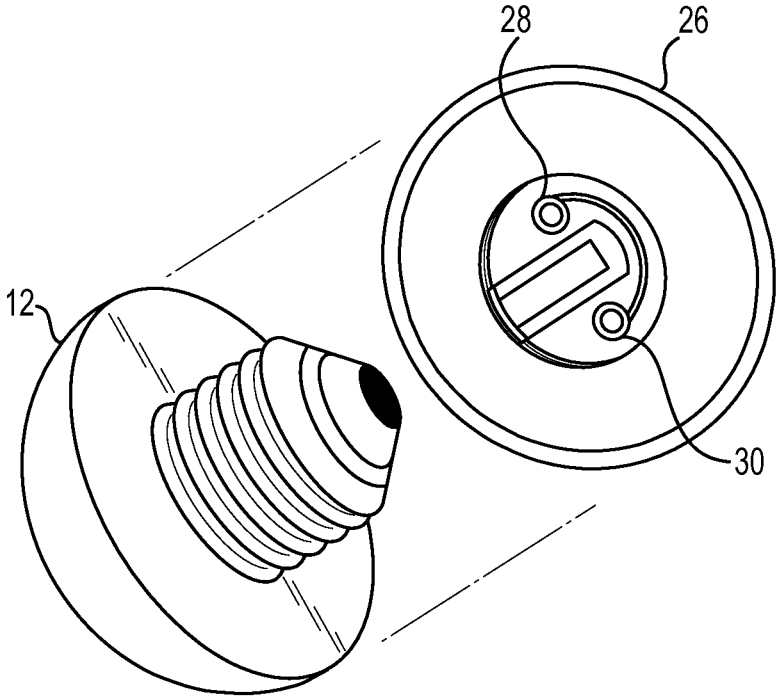
FIG. 3 shows a schematic representation of the white light LED device depicting the activating electronics encased within the first encapsulating housing.

In another embodiment of the present invention, the base housing 26 in FIG. 3 may have 2 separate contacts 28 and 30 that mate with a matching connector on module 12. The threaded base and threaded socket are configured as 3-way lamp conductors, wherein the threads of the threaded base and threaded socket are electrically isolated from the electrical circuit so as to conduct the current while not energizing the heatsink 26.

In yet another embodiment of the present invention, the LED devices mounted on circuit board 16 may be a mixture of some LEDs compatible with a direct current (DC) drive voltage and other LED devices designed to be driven by an alternating current (AC) drive voltage. In this configuration, circuit board 16 may be configured to supply both the appropriate AC and DC drive voltages to the respective AC and DC LED devices.

Figure 2:
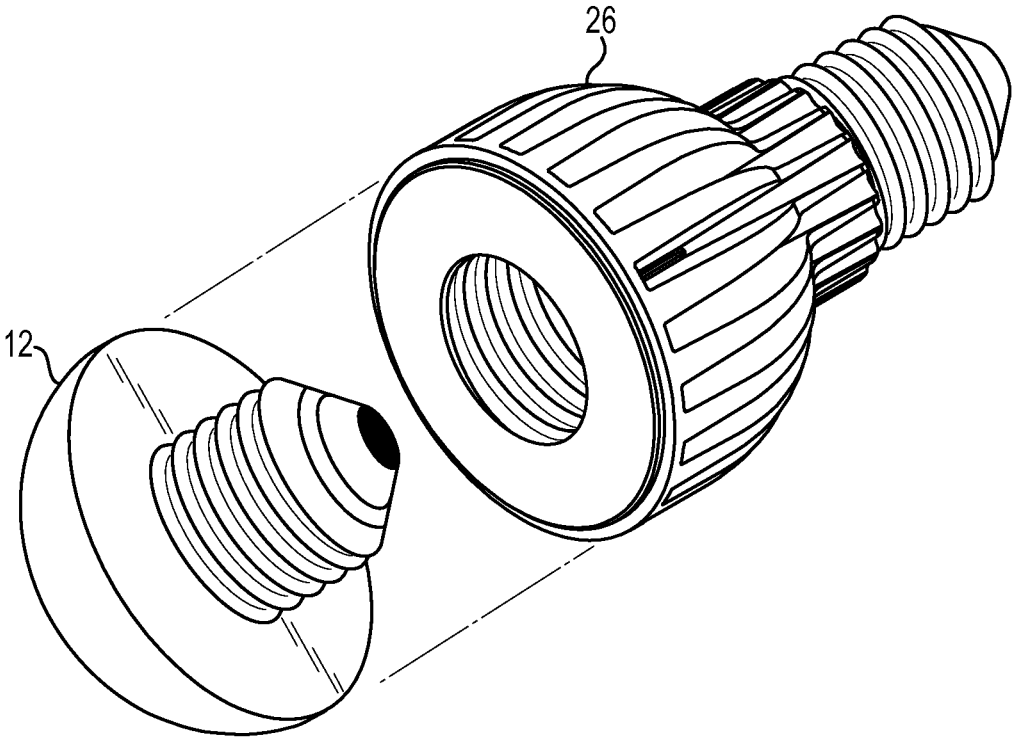
FIG. 2 shows a schematic representation of the white light LED device depicted in FIG. 1, highlighting the disassembly of the opto-electronic subassembly from the heat sinking subassembly.

FIG. 1 also depicts heat sinking elements 24 running vertically along a portion of the lateral surface of the white light LED device 10. As shown in FIG. 2, encapsulating housing 12 (encasing the LED's and activating electronics) may be mechanically disengaged from encapsulating housing 26. This modular design approach may make it possible to mix and match components for the following reasons:

1. In cases where the LEDs and/or electronics may fail, a replacement encapsulating housing 12 (encasing new LED's and activating electronics) may be mechanically mated with encapsulating housing 26.
2. In cases where new more energy efficient LEDs become available, a replacement encapsulating housing 12 (encasing new LED's and activating electronics) may be mechanically mated with encapsulating housing 26.
3. In cases where it is desirable to convert the activating electronics from DC (direct current) activating electronics to AC (alternating current) electronics or vice versa by way of replacing encapsulating housing 12.
4. In cases where it is desirable to convert the activating electronics from 115 Volts AC (U.S. standard) to 230 Volts AC (European standard) by way of replacing encapsulating housing 12 with a new replacement housing with the appropriate LEDs and activating electronics.
5. In cases where it is desirable to convert the LEDs to change the color temperature of the white light LED device (for example, replacing a so-called "warm" LED as defined earlier in the specification above, with a so-called "cool" LED or vice versa).
6. In cases where it is desirable to convert the LEDs and/or its' associated optics to change the beam angle emanating from the LED's to a spot or flood pattern. In all of these cases, the modular design approach allows for using the heat sinking assembly with alternative LEDs and activating electronics.
7. In cases where it is desirable to replace the LEDs with different LED's with a different wattage rating.
8. In cases where it is desirable to replace the LEDs with different LED's with a different lifetime rating.
9. Or, in cases where it is desirable to change the number of LEDs in the device.

The present invention should not be considered limited to the particular examples described above, but rather should be understood to cover all aspects of the invention as fairly set out in the attached claims. Various modifications to the shape and form factors described above, equivalent processes to supplying the appropriate drive voltages to the LEDs, as well as numerous structures to which the present invention may be applicable will be readily apparent to those of skill in the art to which the present invention is directed upon review of the present specification. One such example is the so-called "vanity lights" generally categorized by the American National Standards Institute (ANSI) as having part numbers G15-1/2, G25, or G40, which are incorporated in the present application by reference thereto. The following claims are intended to cover such modifications and devices.

I claim:

1. A lighting device for replacement of an ANSI standard light bulb, the device comprising:

an opto-electronic subassembly and a heat sinking subassembly, wherein the opto-electronic subassembly is removable from and replaceable in the heat sinking subassembly wherein the opto-electronic subassembly includes a plurality of solid state light emitters;

activating electronics coupled to the solid state light emitters and configured to activate the solid state light emitters, wherein the activating electronics are entirely contained within the opto-electronic subassembly;

a first housing containing the solid state light emitters and the activating electronics; and wherein the heat sinking subassembly includes a second housing including a heat sinking surface, and wherein the heat sinking subassembly includes two or more conductors that conduct current through the heat sinking subassembly;

the opto-electronic subassembly having the first housing and the solid state light emitters and the activating electronics contained therein is removably coupled to the heat sinking subassembly having the second housing and the heat sinking surface;

wherein when the opto-electronic subassembly having the first housing is coupled to the heat sinking subassembly having the second housing, electrical current is conducted through the second housing to the solid state light emitters and the activating electronics contained in the first housing, and the heat sinking surface sinks heat away from the solid state light emitters and activating electronics; and wherein the lighting device has a shape and form factor substantially equivalent to one of a plurality of light bulb shape and form factors defined by the American National Standards Institute (ANSI).

2. The device of claim 1 wherein the lighting device is configured to generate diffuse white light.

3. The device of claim 1 wherein when the first housing is coupled to the second housing, the lighting device has a shape and form factor substantially equivalent to one of the group consisting of ANSI lighting device standards R-20, R-30, R-38, R-40, BR-20, BR-30, BR-38, BR-40, PAR-16, PAR-20, PAR-30, PAR-38, PAR-40, MR-16, A-15, A-19, A-21, A-23, B-10- 1/2, B-13, G-16-1/2, G-25, G-40, P-25, PS-35, T-10, C-7, F-10, F-15, and F-20.

4. The device of claim 1 wherein the solid-state light emitters comprise light emitting diodes (LED's).

5. The device of claim 1 wherein the LED's are energized by a direct current (DC) voltage.

6. The device of claim 1 wherein the LED's are energized by an alternating current (AC) voltage.

7. The device of claim 1 wherein the LED's are energized by a combination of a direct current (DC) voltage, and an alternating current (AC) voltage.

8. The device of claim 1 wherein the activating electronics are configured to convert 120 volt 60 cycles per second alternating current to a steady state direct current (DC) voltage.

9. The device of claim 1 wherein the activating electronics are configured to convert 240 volt 50 cycles per second alternating current to a steady state direct current (DC) voltage.

10. The device of claim 1 wherein the activating electronics are configured as an AC-to-AC converter.

11. The device of claim 1 wherein the activating electronics are configured as an AC-to-DC converter.

12. The device of claim 1 wherein the first housing includes a threaded base configured to be screwed into a threaded socket in the second housing.

13. The device of claim 12 wherein the threaded base and threaded socket are configured 3-way lamp conductors, wherein current is conducted only by two center conductors of the 3-way lamp conductors, and wherein the threads of the threaded base and threaded socket are electrically isolated from the activating electronics.

14. The device of claim 12 wherein the second housing has a threaded lamp base as defined in one of the group consisting of ANSI lighting device standards R-20, R-30, R-38, R-40, BR-20, BR-30, BR-38, BR-40, PAR-16, PAR-20, PAR-30, PAR-38, PAR-40, MR-16, A-15, A-19, A-21, A-23, B-10-1/2, B-13, G-16-1/2, G-25, G-40, P-25, PS-35, T-10, C-7, F-10, F-15, and F-20.

15. The device of claim 1 wherein the first housing attaches to the second housing a push-and-twist locking mechanism.

* * * * *